United States Patent [19]

Shannon

[11] Patent Number: 4,928,714

[45] Date of Patent: May 29, 1990

[54] SMOKING ARTICLE WITH EMBEDDED SUBSTRATE

[75] Inventor: Michael D. Shannon, Winston-Salem, N.C.

[73] Assignee: R. J. Reynolds Tobacco Company, Winston-Salem, N.C.

[21] Appl. No.: 723,382

[22] Filed: Apr. 15, 1985

[51] Int. Cl.[5] ..... A24D 1/18; A24D 1/00; A24D 1/02

[52] U.S. Cl. ..... 131/359; 131/273; 131/335; 131/196; 131/360

[58] Field of Search ..... 131/360, 364, 194, 273, 131/356, 337, 335, 329, 362, 364

[56] References Cited

U.S. PATENT DOCUMENTS

| | | |
|---|---|---|
| Re. 27,214 | 11/1971 | Nakahara . |
| 1,529,181 | 12/1924 | Holmes . |
| 2,907,686 | 10/1959 | Siegel . |
| 3,258,015 | 6/1966 | Ellis . |
| 3,356,094 | 12/1967 | Ellis . |
| 3,516,417 | 6/1970 | Moses . |
| 3,738,374 | 7/1973 | Bennett . |
| 3,943,941 | 4/1976 | Boyd . |
| 4,044,777 | 8/1977 | Boyd . |
| 4,079,742 | 4/1978 | Ranier . |
| 4,284,089 | 8/1981 | Ray . |
| 4,286,604 | 9/1981 | Ehretsmann . |
| 4,326,544 | 4/1982 | Hardwick . |
| 4,340,072 | 7/1982 | Bolt . |
| 4,347,855 | 9/1982 | Lanzilloti et al. . |
| 4,391,285 | 7/1983 | Burnett et al. . |
| 4,407,308 | 10/1983 | Baker . |
| 4,474,191 | 10/1984 | Steiner . |

FOREIGN PATENT DOCUMENTS

| | | |
|---|---|---|
| 276250 | 1/1964 | Australia . |
| 0117355 | 9/1984 | European Pat. Off. . |
| 1294351 | 9/1975 | Fed. Rep. of Germany . |
| 2057421 | 12/1984 | France . |
| 2057422 | 12/1984 | France . |
| 35-9894 | 5/1960 | Japan . |
| 42-8684 | 12/1967 | Japan . |
| 1431045 | 4/1972 | United Kingdom . |

OTHER PUBLICATIONS

Influence of Filter Additives on Smoke Composition, Rec. Adv. Tob, Sci., 4:47 (1978) M. L. Reynolds.

L. L. Lyerly, "Direct Vapor Chromotographic Determination of*** Triacetin in Cigarette Smoke," Tob Sci. 11:49 (1967).

J. E. Kiefer, et al., "Factors That Affect Elution of Plasticizer from Cigarette Filters", Eastman Kodak Publ. No. FTR-65.

Guinness World Book of Records, pp. 242-243 (1985 Edition).

Guinnes World Book of Records, p. 194 (1966 Edition).

C. Hagg, General Inorganic Chemistry, at p. 592 (John Wiley & Sons, 1969).

Ames et al., Mut. Res. 31: 347-364 (1973).

Nago et al., Mut. Res. 42:335 (1977).

Hach's Chem. Dictionary, 34, 4th ed. (1969).

Lange's Handbook of Chemistry, 10: 272-74 (11th ed. 1973).

U.S. Pat. No. 4,347,855 (9/82) Lanzilloti et al.

U.S. Pat. No. 4,391,285 (7/83) Burnett et al.

U.S. Pat. No. 4,474,191 (10/84) Steiner.

U.S. Pat. No. 4,219,031 (8/80) Ranier.

U.S. Pat. No. 3,614,956 (10/71) Thornton.

Marshall Sittig, Tobacco Substitutes, Noyes Data Corp. (1976).

*Primary Examiner*—V. Millin

*Attorney, Agent, or Firm*—Grover M. Myers; David G. Conlin

[57] ABSTRACT

The smoking article of the present invention has a short, combustible, preferably carbonaceous, fuel element, generally less than about 30 mm long, which is substantially free of volatile organic material. A physically separate aerosol generating means, preferably comprising a substrate bearing an aerosol forming substance, is located within a cavity in the fuel element, i.e., the aerosol generating means is at least partially embedded in the fuel element. This article may be provided with an external insulating member to reduce radial heat loss and/or with a heat conducting member to increase conductive heat transfer from the fuel element to the aerosol generating means.

28 Claims, 1 Drawing Sheet

SMOKING ARTICLE WITH EMBEDDED SUBSTRATE

BACKGROUND OF THE INVENTION

The present invention relates to a smoking article which produces an aerosol that resembles tobacco smoke which preferably contains no more than a minimal amount of incomplete combustion or pyrolysis products.

Many smoking articles have been proposed through the years, especially over the last 20 to 30 years. But none of these products has ever realized any commercial success.

Tobacco substitutes have been made from a wide variety of treated and untreated plant material, such as cornstalks, eucalyptus leaves, lettuce leaves, corn leaves, cornsilk, alfalfa, and the like. Numerous patents teach proposed tobacco substitutes made by modifying cellulosic materials, such as by oxidation, by heat treatment, or by the addition of materials to modify the properties of cellulose. One of the most complete lists of these substitutes is found in U.S. Pat. No. 4,079,742 to Rainer et al. Despite these extensive efforts, it is believed that none of these products has been found to be completely satisfactory as a tobacco substitute.

Many proposed smoking articles have been based on the generation of either an aerosol or a vapor. Some of these products purportedly produce an aerosol or a vapor without heat. See, e.g., U.S. Pat. No. 4,284,089 to Ray. However, the aerosols or vapors from these articles fail to adequately simulate tobacco smoke.

Some of the proposed aerosol generating articles have used a heat source in order to produce the aerosol. However, none of these articles has ever achieved any commercial success, and it is believed that none has ever been widely marketed. The absence of such articles from the marketplace is believed to be due to a variety of reasons, including insufficient aerosol generation, both initially and over the life of the product, poor taste, off-taste due to the thermal degradation of the smoke former and/or flavor agents, the presence of substantial pyrolysis products and sidestream smoke, and unsightly appearance.

One of the earliest of these proposed articles was described by Siegel in U.S. Pat. No. 2,907,686. Siegel proposed a cigarette substitute which included an absorbent carbon fuel, preferably a 2½ inch stick of charcoal, which was burnable to produce hot gases, and a flavoring agent carried by the fuel, which was adapted to be distilled off incident to the production of the hot gases. Siegel also proposed that a separate carrier could be used for the flavoring agent, such as a clay, and that a smoke-forming agent, such as glycerol, could be admixed with the flavoring agent.

Siegel's proposed smoking substitute would be coated with a concentrated sugar solution to provide an impervious coat and to force the hot gases and flavoring agents to flow toward the mouth of the user. It is believed that the presence of the flavoring and/or smoke-forming agents in the fuel of Siegel's article would cause substantial thermal degradation of those agents and an attendant off-taste. Moreover, it is believed that the article would tend to produce substantial sidestream smoke containing the aforementioned unpleasant thermal degradation products.

Another such article was described by Ellis et al. in U.S. Pat. No. 3,258,015. Ellis et al. proposed a smoking article which had an outer cylinder of fuel having good smoldering characteristics, preferably fine cut tobacco or reconstituted tobacco, surrounding a metal tube containing tobacco, reconstituted tobacco, or other source of nicotine and water vapor. On smoking, the burning fuel heated the nicotine source material to cause the release of nicotine vapor and potentially aerosol generating material, including water vapor. This was mixed with heated air which entered the open end of the tube. A substantial disadvantage of this article was the ultimate protrusion of the metal tube as the tobacco fuel was consumed. Other apparent disadvantages of this proposed smoking article include the presence of substantial tobacco pyrolysis products, the substantial tobacco sidestream smoke and ash, and the possible pyrolysis of the nicotine source material in the metal tube.

In U.S. Pat. No. 3,356,094, Ellis et al. modified their original design to eliminate the protruding metal tube. This new design employed a tube made out of a material, such as certain inorganic salts or an epoxy bonded ceramic, which became frangible upon heating. This frangible tube was then broken up and removed when the smoker eliminated ash from the end of the article. Even though the appearance of the article was very similar to a conventional cigarette, apparently no commercial product was ever marketed.

In U.S. Pat. No. 3,738,374, Bennett proposed the use of carbon or graphite fibers, mat, or cloth associated with an oxidizing agent as a substitute cigarette filler. Flavor was provided by the incorporation of a flavor or fragrance into the mouthend of an optional filter tip.

U.S. Pat. Nos. 3,943,941 and 4,044,777 to Boyd et al. and British Pat. No. 1,431,045 proposed the use of a fibrous carbon fuel which was mixed or impregnated with volatile solids or liquids which were capable of distilling or subliming into the smoke stream to provide "smoke" to be inhaled upon burning of the fuel. Among the enumerated smoke producing agents were polyhydric alcohols, such as propylene glycol, glycerol, and 1,3 butylene glycol, and glyceryl esters, such as triacetin. Despite Boyd et al.'s desire that the volatile materials distill without chemical change, it is believed that the mixture of these materials with the fuel would lead to substantial thermal decomposition of the volatile materials with the concomitant production of bitter off-tastes. Similar products were proposed in U.S. Pat. No. 4,286,604 to Ehretsmann et al. and in U.S. Pat. No. 4,326,544 to Hardwick et al.

Bolt et al., in U.S. Pat. No. 4,340,072 proposed a smoking article having a fuel rod with a central air passageway and a mouthend chamber containing an aerosol forming agent. The fuel rod preferably was a molding or extrusion of reconstituted tobacco and/or tobacco substitute, although the patent also proposed the use of tobacco, a mixture of tobacco substitute material and carbon, or a sodium carboxymethylcellulose (SCMC) and carbon mixture. The aerosol forming agent was proposed to be a nicotine source material, or granules or microcapsules of a flavorant in triacetin or benzyl benzoate. Upon burning, air entered the air passage where it was mixed with combustion gases from the burning rod. The flow of these hot gases reportedly ruptured the granules or microcapsules to release the volatile material. This material reportedly formed an aerosol and/or was transferred into mainstream flow. It is believed that the articles of Bolt et al., due in part to the long fuel rod, would produce insufficient aerosol from the aerosol former to be acceptable, especially in the early puffs. The use of microcapsules or granules would further impair aerosol delivery because of the heat needed to rupture the wall material. Moreover, total aerosol delivery would appear to be dependent on the use of tobacco or tobacco substitute materials, which upon burning would produce substantial pyrolysis products and sidestream smoke which would not be desirable in this type of smoking article.

U.S. Pat. No. 3,516,417 to Moses proposed a smoking article, with a tobacco fuel, which was identical to the article of Bolt et al., except that Moses used a double density plug of tobacco in lieu of the granular or microencapsulated flavorant of Bolt et al. See FIG. 4, and col. 4, lines, 17–35. This article would suffer many of the same problems as the articles proposed by Bolt et al.

Thus, despite decades of interest and effort, there is still no smoking article on the market which provides the benefits and advantages associated with conventional cigarette smoking, but without the presence of the substantial pyrolysis and incomplete combustion products present in cigarette smoke.

SUMMARY OF THE INVENTION

The present invention relates to a smoking article which is capable of producing substantial quantities of aerosol, both initially and over the useful life of the product, preferably without significant thermal degradation of the aerosol former and without the presence of substantial pyrolysis or incomplete combustion products or sidestream smoke. Thus, preferred articles of the present invention are able to provide the user with the sensations and benefits of cigarette smoking without burning tobacco.

These and other advantages are obtained by providing a smoking article which utilizes a combustible fuel element, preferably of a carbonaceous material, in conjunction with a physically separate aerosol generating means within the cavity in the fuel element. Preferably, the fuel element is less than about 30 mm in length and the aerosol generating means includes a heat stable substrate bearing one or more aerosol forming substances. In addition, a heat conducting or insulating member, such as a metal foil or a jacket of insulating fibers, can be used to aid in the transfer of heat to the aerosol generating means by increasing conductive heat transfer or by reducing radial heat loss, respectively.

As used herein, and only for the purposes of this application, "aerosol" is defined to include vapors, gases, particles, and the like, both visible and invisible, and especially those components perceived by the user to be "smoke-like", generated by action of the heat from the burning fuel element upon substances contained within the aerosol generating means, or elsewhere in the article. As so defined, the term "aerosol" also includes volatile flavoring agents and/or pharmacologically or physiologically active agents, irrespective of whether they produce a visible aerosol.

As used herein, the term "physically separate" means that the substrate or carrier for the aerosol forming substance is not mixed with, or a part of, the fuel element.

In a preferred aspect of the present invention, the smoking article has a short, combustible carbonaceous fuel element, generally less than about 30 mm long, which is substantially free of volatile organic material. More preferably, the fuel element is less than about 15 mm in length. While not preferred, other fuel elements may be employed, such as tobacco substitutes and like materials.

A physically separate aerosol generating means comprising a substrate, carrier or container including an aerosol forming substance, is located at least partially within a cavity in the fuel element, i.e., the aerosol generating means is at least partially embedded in the fuel element. This placement ensures virtually constant heat exchange between the burning fuel element and the aerosol generating means. A preferred aerosol generating means comprises a relatively short mass of porous substrate material, generally less than about 30 mm long, with a diameter the same as or just slightly smaller than the diameter of the cavity in the fuel element, impregnated with one or more aerosol forming substances. Other preferred aerosol generating means include particulate substrates located within a metallic container. In many preferred embodiments the substrate is wholly embedded within the cavity in the fuel element. More preferably, the wholly embedded aerosol generating means is less than about 15 mm in length. Generally, the embedded aerosol generating means is set back or recessed from the lighting end of the fuel element. It is possible however, that the aerosol generating means may be embedded at any position within the fuel element so long as the aerosol produced therein is not significantly degraded by heat from the burning fuel element.

The smoking article of the present invention normally is provided with a mouthend piece including means, such as a longitudinal passage, for delivering the aerosol to the user. Advantageously, the article has the same overall dimensions as a conventional cigarette, and as a result, the mouthend piece and the aerosol delivery means usually extend over more than one-half the length of the article. Alternatively, the fuel element and the aerosol generating means may be produced without a built-in mouthend piece or aerosol delivery means, for use with a separate, disposable or reusable mouthend piece.

Upon lighting, the fuel element generates heat which is used to volatilize the aerosol forming substance or substances contained in the aerosol generating means. These volatile materials are then drawn toward the mouth end, especially during puffing, and into the user's mouth, akin to the smoke of a conventional cigarette. Because the preferred fuel element is relatively short, and because of the embedded position of the aerosol generating means, the hot, burning fire cone is always close to the aerosol generating means thereby maximizing heat exchange with the aerosol generating means and the resulting production of large quantities of aerosol.

The use of a relatively short, low mass aerosol generating means embedded within the fuel element, also increases aerosol production by minimizing any heat sink effect of the aerosol generating means. Because the aerosol forming substance is physically separate from the fuel element, it is exposed to substantially lower temperatures than are present in the burning fire core, which minimizes the possibility of thermal degradation of the aerosol former. In addition, the preferred substrate is generally a thermally stable material, i.e., it does not burn, pyrolize, or otherwise substantially degrade upon exposure to heat from the burning fuel element. Moreover, the use of the preferred carbonaceous fuel element, which is substantially free of volatile organic material, eliminates the presence of substantial pyrolysis or incomplete combustion products and the presence of substantial sidestream smoke.

In another aspect of the present invention, conductive heat exchange between the fuel element and aerosol generating means may be augmented by the use of a conductive member, such as a metal foil, which advantageously contacts at least a portion of the fuel element and at least a portion of the aerosol generating means. Contact of the metal foil is preferably along the internal longitudinal surfaces of the fuel element and the external longitudinal surface of the aerosol generating means. This foil also acts as a barrier, which substantially reduces the amount of combustion and/or pyrolysis products from the burning fuel source entering the aerosol stream.

Alternatively, or additionally, an insulating member, such as resilient insulating fibers, preferably at least 0.5 mm thick, may be employed surrounding the outer periphery of at least a portion of the fuel element. Use of such a member retains and directs heat from the burning fuel element toward the embedded aerosol generating means.

In a particularly preferred embodiment of the smoking article of the present invention may also include a charge of tobacco which is used to add tobacco flavors to the aerosol. The tobacco may be placed at the mouthend of the aerosol generating means, or it may be mixed with the substrate or carrier for the aerosol forming substance. In some embodiments, tobacco may be used in lieu of the substrate or carrier for the aerosol forming substance. Other substances may be incorporated in a similar manner.

Preferred embodiments of the invention are capable of delivering at least 0.6 mg of aerosol, measured as wet total particulate matter (WTPM), in the first 3 puffs, when smoked under standard FTC smoking conditions, which consist of a 35 ml puff of two seconds duration separated by 58 seconds of smolder. More preferably, preferred embodiments of the invention are capable of delivering 1.5 mg or more of aerosol in the first 3 puffs. Most preferably, preferred embodiments of the invention are capable of delivering 3 mg or more of aerosol in the first 3 puffs when smoked under standard FTC smoking conditions. Moreover, preferred embodiments of this invention deliver an average of at least about 0.8 mg of WTPM per puff under standard FTC smoking conditions.

In addition to the aforementioned benefits, the preferred smoking articles of the present invention provide an aerosol which is chemically simple, consisting essentially of air, oxides of carbon, water, and the aerosol former which carries any desired flavors or other desired volatile materials as well as trace amounts of other materials. This aerosol has no significant mutagenic activity as measured by the Ames Test. In addition, the article may be made virtually ashless so that the user does not have to remove any ash during use.

The preferred smoking articles of the present invention are described in greater detail in the accompanying drawings and in the detailed description of the invention which follows.

DETAILED DESCRIPTION OF THE PREFERRED EMBODIMENTS

Figure 1:
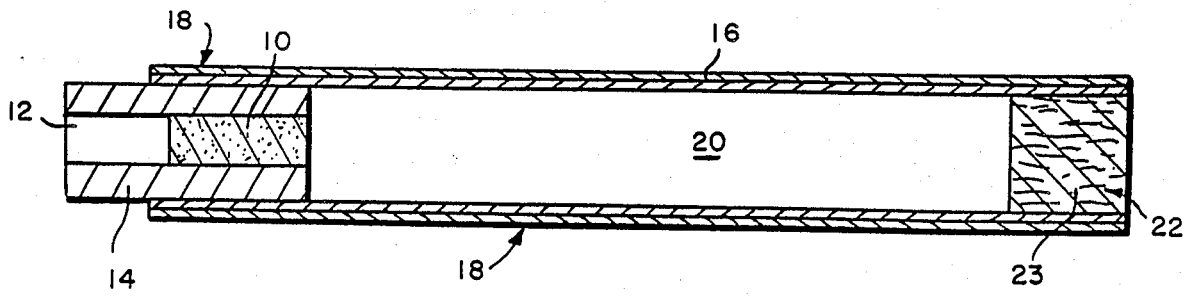
FIGS. 1, 2 and 3 are longitudinal, sectional views of three preferred embodiments of the present invention.

The embodiment of the invention illustrated in FIG. 1 which has about the same diameter as a conventional cigarette, shows one configuration of an embedded aerosol generating means, comprising a substrate 10 contained completely within a large cavity 12 in fuel element 14.

In this embodiment, the fuel element 14 preferably is formed from an extruded carbon, and the substrate 10 is a thermally stable, relatively rigid material, such as a porous mass of carbon, bearing one or more aerosol forming substances. However, the fuel element may be prepared from a pressed or molded carbon source. One or more axially extending holes may be placed, either during formation, or after formation, in the fuel element and/or the substrate. This embodiment also includes a foil lined paper tube 16 as the mouthend piece. This foil lined tube serves to hold fuel element 14 in place as well as helping to extinguish the fuel. The foil lined paper tube 16, surrounds the rear, non-lighting end of fuel element 14 and forms an aerosol delivery passage 20 between the aerosol generating means and the mouth end 22 of the article. As shown, mouth end 22 includes a low density cellulose acetate tow filter element 23. The entire length of the article is wrapped with conventional cigarette paper 18.

Although not illustrated, an optional mass of tobacco may be placed inside the foil lined tube, preferably near the substrate. A conductive member such as a metal foil also may be provided between the fuel element and the substrate to increase heat transfer to the substrate. Similarly, an insulating member may be provided surrounding at least a portion of the outer periphery of the fuel element to direct heat to the embedded substrate.

Figure 2:
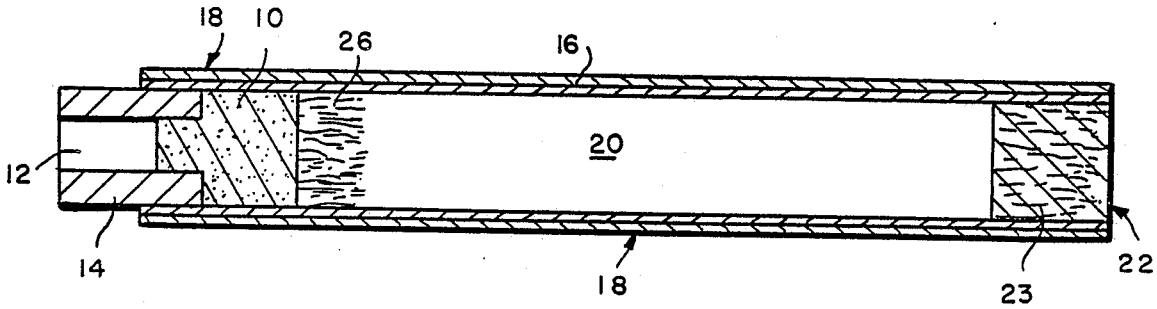

The embodiment illustrated in FIG. 2 is similar to the embodiment of FIG. 1, except that the substrate is not wholly embedded within the cavity in the fuel element. As illustrated, fuel element 14 has a cavity 12. Substrate 10 is a mass of porous carbon, having a reduced diameter at the fuel element end, which fits within cavity 12. The remainder of the substrate abuts the fuel element and is contained within the foil lined paper tube mouthend piece 16. Tobacco charge 26, cigarette paper overwrap 18, and a low density cellulose acetate tow filter element 23 complete this article.

Figure 3:
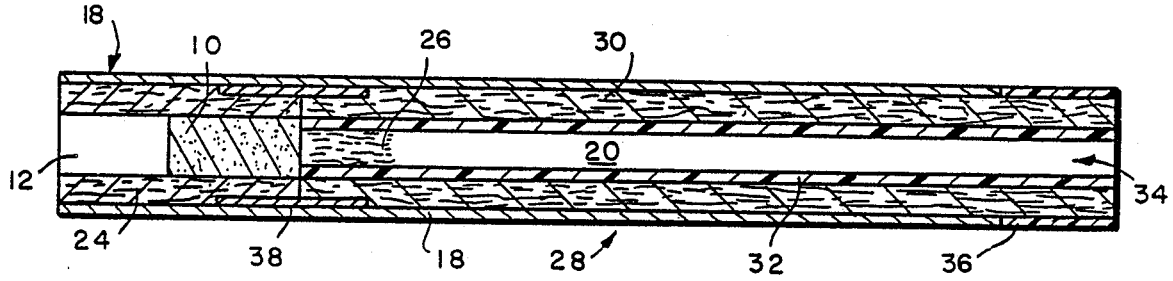

The embodiment illustrated in FIG. 3 includes a fibrous carbon fuel element 24, such as carbonized cotton or rayon. The substrate 10 is a cylindrical block of thermally stable carbon embedded in cavity 12 of fuel element 14. A mass of tobacco 26 is located immediately behind the substrate 10. This article is provided with a cellulose-acetate tube mouthend piece 28, in place of the foil lined paper tube of the embodiment shown in FIGS. 1 and 2. This tube 28 includes an annular section 30 of cellulose acetate tow surrounding an optional plastic, e.g., polypropylene or Mylar, tube 32. The mouth end 34 of this element is hollow. The entire length of the article is wrapped in white cigarette paper 18. A cork or white ink coating 36 may be used at the mouth end to simulate tipping. A foil strip 38 is located on the inside of the paper, toward the fuel end of the article. This strip couples the fuel element 24 to the mouth end piece 28, and aids in extinguishing the fuel. It may be integral with the paper or it may be a separate piece applied before the paper overwrap.

Upon lighting any of the aforesaid embodiments, the fuel element burns generating the heat used to volatilize the aerosol forming substance or substances present in the aerosol generating means. These volatile materials are then drawn down the passage toward the mouthend, especially during puffing, and into the user's mouth, akin to the smoke of a conventional cigarette. Because the aerosol forming substance is physically separate from the fuel element, it is exposed to substantially lower temperatures than are present in the burning fire cone. This minimizes the possibility of thermal degradation of the aerosol former. This also results in aerosol production during puffing, but little or no aerosol production during smolder. In addition, the use of the preferred carbonaceous fuel elements and a physically separate aerosol generating means eliminates the presence of substantial pyrolysis or incomplete combustion products and avoids the production of substantial sidestream smoke.

If a charge of tobacco is employed, hot vapors are swept through the bed of tobacco to extract and vaporize the volatile components in the tobacco, without the need for tobacco combustion. Thus the user of this smoking article receives an aerosol which contains the qualities and flavors of natural tobacco without the combustion products produced by a conventional cigarette.

Because of the small size and burning characteristics of the preferred carbonaceous fuel element employed in the present invention, the fuel element usually begins burning over substantially all of its exposed length within a few puffs. Thus, the portion of the fuel element adjacent to the aerosol generating means becomes hot quickly, which significantly increases heat transfer to the aerosol generating means especially during the early and middle puffs. Because the preferred fuel element is short, there is never a long section of nonburning fuel to act as a heat sink, as in previous thermal aerosol articles.

In the foregoing embodiments of the invention, the short fuel element and the mouthend piece cooperate with the embedded aerosol generating means to provide a system which is capable of producing substantial quantities of aerosol throughout the life of the fuel element, and especially during the early and middle puffs. The close proximity of the fire cone to the aerosol generating means after a few puffs results in heat delivery during puffing and during the relatively long period of smolder between puffs. (FTC smoking standards consist of two seconds of puffing (35 ml volume) separated by 58 seconds of smolder.)

While not wishing to be bound by theory, it is believed that the aerosol generating means is maintained at a relatively high temperature between puffs and that the additional heat delivered during puffs is primarily utilized to vaporize the aerosol forming substance. This increased heat transfer makes more efficient use of the available fuel energy, reduces the amount of fuel needed, and helps deliver early aerosol. Further, the heat transfer utilized in the present invention is believed to reduce the carbon fuel combustion temperature which, it is further believed, reduces the $CO/CO_2$ ratio in the combustion products produced by the fuel. See, e.g., G. Hagg, *General Inorganic Chemistry*, at p. 592 (John Wiley & Sons, 1969).

In general, the combustible fuel elements which may be employed in practicing the invention are less than about 30 mm long. Advantageously the fuel element is about 20 mm or less, preferably about 15 mm or less in length. Advantageously, the diameter of the fuel element is between about 4 to 8 mm, and the diameter of the cavity is between about 1 to 7 mm. The size of the cavity in the fuel element is generally the same as or just slightly larger than the size of the aerosol generating means contained therein. This results in the maximum peripheral contact between the aerosol generating means and the fuel element, thus producing maximum heat transfer between the fuel element and the aerosol generating means.

The preferred fuel elements employed herein are primarily formed of a carbonaceous material. Preferably, the carbon content of such a fuel element is at least 80%, most preferably about 90% or more by weight. High carbon content fuels are preferred because they produce minimal pyrolysis and incomplete combustion products, little or no visible sidestream smoke, minimal ash and high heat capacity. However, lower carbon content fuel elements are within the scope of this invention, especially where a nonburning inert filler is used. Also, while not preferred, other fuel elements may be employed, such as tobacco substitutes and the like.

Carbonaceous fuel elements are most preferably from about 10 to 15 mm in length. The density of the carbonaceous fuel elements has ranged from about 0.5 g/cc to about 1.5 g/cc. Preferably, the density is greater than 0.7 g/cc. Carbonaceous fuel elements having these characteristics are sufficient to provide fuel for at least about 7 to 10 puffs, the normal number of puffs generally obtained by smoking a conventional cigarette under FTC conditions.

The carbonaceous materials used in or as the preferred fuel may be derived from virtually any of the numerous carbon sources known to those skilled in the art. Preferably, the carbonaceous material is obtained by the pyrolysis or carbonization of cellulosic materials, such as wood, cotton, rayon, tobacco, coconut, paper, and the like, although carbonaceous materials from other sources maybe used.

In most instances, the carbonaceous fuel element should be capable of being ignited by a conventional cigarette lighter without the use of an oxidizing agent. Burning characteristics of this type may generally be obtained from a cellulosic material which has been pyrolyzed at temperatures between about 400° C. to about 1000° C., preferably between about 500° C. to about 950° C., in an inert atmosphere or under a vacuum. The pyrolysis time is not believed to be critical, as long as the temperature at the center of the pyrolyzed mas has reached the aforesaid temperature range for at least a few minutes. However, a slow pyrolysis, employing gradually increasing temperatures over several hours is believed to produce a more uniform material with a higher carbon yield.

While undesirable in most cases, carbonaceous fuel elements which require the addition of an oxidizing agent to render them ignitable by a cigarette lighter are within the scope of this invention, as are carbonaceous materials which require the use of a glow retardant or other type of combustion modifying agent. Such combustion modifying agents are disclosed in many patents and publications and are known to those of ordinary skill in the art.

The most preferred carbonaceous fuel elements used in practicing the invention are substantially free of volatile organic material. By that, it is meant that the fuel element is not purposely impregnated or mixed with substantial amounts of volatile organic materials, such as volatile aerosol forming or flavoring agents, which could degrade in the burning fuel. However, small amounts of water, which are naturally adsorbed by the fuel, may be present therein. While undesirable, small amounts of aerosol forming substances may migrate from the aerosol generating means and thus may also be present in the fuel element.

A preferred carbonaceous fuel element is a pressed or extruded carbon mass prepared from carbon and a binder, by conventional pressure forming or extrusion techniques. A preferred activated carbon for such a fuel element is PCB-G, and a preferred non-activated carbon is PXC, both available from Calgon Carbon Corporation, Pittsburgh, Pa. Other preferred carbons for pressure forming and/or extrusion are prepared from pyrolyzed cotton or pyrolyzed papers, such as Grande Prairie Canadian Kraft available from Buckeye Cellulose Corp., Memphis, Tenn.

The binders which may be used in preparing such a fuel element are well known in the art. A preferred binder is sodium carboxymethylcellulose (SCMC), which may be used alone, which is preferred, or in conjunction with materials such as sodium chloride, vermiculite, bentonite, calcium carbonate, and the like. Other useful binders include gums, such as guar gum, and other cellulose derivatives, such as methylcellulose and carboxymethylcellulose (CMC).

A wide range of binder concentrations can be utilized. Preferably, the amount of binder is limited to minimize contribution of the binder to undesirable combustion products. On the other hand, sufficient binder must be included to hold the fuel element together during manufacture and use. The amount used will thus depend on the cohesiveness of the carbon in the fuel element.

In general, the pressed carbon fuel element is prepared by admixing from about 50 to 99 weight percent, preferably about 80 to 95 weight percent, of the carbonaceous material, with from 1 to 50 weight percent, preferably about 5 to 20 weight percent of the binder, with sufficient water to make a paste. The paste is homogenized by mixing and then dried to reduce the moisture content to between about 5 to 10 weight percent. The dried paste is then ground, preferably in a Trost Mill, to a particle size of less than about 20 mesh. This ground material is treated with water to raise the moisture level to about 30 weight percent, and the moist solid is fed to forming means, such as a conventional pill press, wherein a die punch pressure of from about 1,000 pounds (455 kg) to about 10,000 pounds (4550 kg), preferably about 5,000 pounds (2273 kg), of load is applied to create a pressed pellet having the desired dimensions. The pressed pellet is then dried at from about 55° C. to about 100° C. to reduce the moisture content to between 5 to 10 weight percent. The substrate cavity may be drilled using conventional techniques, or it may be formed at the time of pressing.

Alternatively, the forming means used may be a standard extruder. In that case, the ingredients described supra are employed but the amount of water used is just sufficient to obtain a stiff dough consistency. The dough is then extruded into the desired shape and dried. As with the pressed fuel element, the cavity may be formed during the extrusion or may be drilled after drying.

If desired, the aforesaid fuel elements may be pyrolyzed after formation, for example, to about 650° C. for two hours, to convert the binder to carbon thereby forming a virtually 100% carbon fuel element.

The fuel elements employed in the present invention also may contain one or more additives to improve burning, such as up to about 5 weight percent sodium chloride to improve smoldering characteristics and as a glow retardant. Also, up to about 5 weight percent of potassium carbonate may be included to control flammabitity. Additives to improve physical characteristics, such as clays like kaolins, serpentines, attapulgites, and the like also may be used.

Another preferred carbonaceous fuel element is a carbon fiber fuel, which may be prepared by carbonizing a fibrous precursor, such as cotton, rayon, paper, polyacrylonitile, and the like. Generally, pyrolysis at from about 650° C. to 1000° C., preferably at about 950° C., for about 30 minutes, in an inert atmosphere or vacuum, is sufficient to produce a suitable carbon fiber with good burning characteristics. Combustion modifying additives also may be added to these preferred fuels.

The aerosol generating means used in practicing the invention is physically separate from the fuel element. By physically separate it is meant that the substrate, container or chamber which contains the aerosol forming materials is not mixed with, or a part of, the burning fuel element. As noted previously, this arrangement helps reduce or eliminate thermal degradation of the aerosol forming substance and the presence of sidestream smoke. While not a part of the fuel, the aerosol generating means is in a heat exchange relationship with the fuel element. As used herein, a heat exchange relationship is defined as a physical arrangement of the aerosol generating means and the fuel element whereby heat is constantly transferred from the burning fuel element to the aerosol generating means throughout the burning period of the fuel element.

The size of the aerosol generating means should be chosen in accordance with the size of the cavity in the fuel element, thereby maximizing heat transfer. Generally, for a fuel element approximately the diameter of a conventional cigarette, the aerosol generating means will range from about 1 to 7 mm in diameter, preferably from about 2 to 4 mm. Lengths of the aerosol generating means may range from about 2 mm to about 45 mm, preferably less than 30 mm, more preferably less than 15 mm. Wholly embedded substrates will generally range from about 2 to 15 mm in length, depending upon the length of the fuel element. In addition, the aerosol generating means may be provided with one or more longitudinally extending holes to increase air flow and reduce pressure drop.

Preferably, the aerosol generating means includes one or more thermally stable materials which carry one or more aerosol forming substances. As used herein, a thermally stable material is one capable of withstanding the high temperatures, e.g., 400° C.–600° C., which exist near the fuel without decomposition or burning. The use of such material is believed to help maintain the simple "smoke" chemistry of the aerosol, as evidenced by the lack of Ames activity. While not preferred, other aerosol generating means, such as heat rupturable microcapsules, or solid aerosol forming substances, are within the scope of the invention, provided they are capable of releasing sufficient aerosol forming vapors to satisfactorily resemble tobacco smoke.

Thermally stable materials which may be used as a substrate or carrier for the aerosol forming substance are well known to those skilled in the art. Useful substrates should be porous and must be capable of retaining an aerosol forming compound when not in use and capable of releasing a potential aerosol forming vapor upon heating by the fuel element.

Useful thermally stable materials include thermally stable adsorbent carbons, such as electrode grade carbons, graphite, activated, or nonactivated carbons, and the like. Other suitable materials include inorganic solids such as ceramics, glass, alumina, vermiculite, clays such as bentonite, and the like. The currently preferred substrate materials are carbon felts, fibers, and mats, activated carbons, and porous carbons such as PC-25 and PC-60 available from Union Carbide, as well as SGL carbon available from Calgon. Depending upon the particular aerosol generating means employed herein, the composition and configuration thereof may generally be selected from particulate, fibrous, porous blocks, solid blocks with one or more axially extending passageways therethrough, and the like. Substrates, especially particulates, may be placed within a container, preferably formed from a metallic foil.

It has been found that particularly advantageous particulate substrates may be formed from carbon, tobacco, or mixtures thereof into composite particles in a process using a machine made by Fuji Paudal KK (formerly Fuji Denki Kogyo KK) of Japan, and sold by Luwa Corporation, Charlotte, N.C. under the trade name of "Marumerizer." For a description of such apparatus see German Pat. No. 1,294,351 and U.S. Pat. No. 3,277,520 (now reissued as No. 27,214) as well as Japanese published specification No. 8684/1967. This equipment densifies and shapes materials treated therewith.

The aerosol forming substance or substances used in the invention must be capable of forming an aerosol at the temperatures present in the aerosol generating means when heated by the burning fuel element. Such substances preferably will be composed of carbon, hydrogen and oxygen, but they may include other materials. The boiling point of the substance and/or the mixture of substances can range up to about 500° C. Substances having these characteristics include polyhydric alcohols, such as glycerin and propylene glycol, as well as aliphatic esters of mono-, di-, or poly-carboxylic acids, such as methyl stearate, dodecandioate, dimethyl tetradodecandioate, and others.

Preferably, the aerosol forming substances will include a mixture of a high boiling, low vapor pressure substance and a low boiling, high vapor pressure substance. It is believed, on early puffs, the low boiling substance will provide most of the initial aerosol, while, when the temperature in the aerosol generating means increases, the high boiling substance will provide most of the aerosol.

The preferred aerosol forming substances are polyhydric alcohols, or mixtures of polyhydric alcohols. One preferred aerosol former is a mixture of glycerin and propylene glycol, substances are present in a weight ratio of from 1:10 to 10:1, preferably from 1:4 to 4:1. A more preferred aerosol former is glycerin.

The aerosol forming substance may be dispersed on or within the aerosol generating means in a concentration sufficient to permeate or coat the substrate, carrier, or container. For example, the aerosol forming substance may be applied full strength or in a dilute solution by dipping, spraying, vapor deposition, or similar techniques. The aerosol forming substances can be in solid, semisolid, or liquid form. Solid aerosol forming components may be admixed with the substrate and distributed evenly throughout prior to formation and insertion into the fuel cavity.

While the loading of the aerosol forming substance will vary from carrier to carrier and from aerosol forming substance to aerosol forming substance, the amount of liquid aerosol forming substances may generally vary from about 20 mg to about 120 mg, preferably from about 35 mg to about 85 mg, and most preferably from about 45 mg to about 65 mg. As much as possible of the aerosol former carried on the aerosol generating means should be delivered to the user as WTPM. Preferably, above about 2 weight percent, more preferably above about 15 weight percent, and most preferably above about 20 weight percent of the aerosol former carried on the aerosol generating means is delivered to the user as WTPM.

The aerosol generating means also may include one or more volatile flavoring agents, such as menthol, vanillin, artificial coffee, tobacco extracts, nicotine, caffeine, liquors, and other agents which impart flavor to the aerosol. It also may include any other desirable volatile solid or liquid materials.

Alternatively, these optional agents may be placed between the aerosol generating means and the mouthend, such as in a separate substrate or chamber in passage 26 which connects the aerosol generating means to the mouthend, or in the optional tobacco charge. For example, a semi-solid aerosol former comprising particulate tobacco or other materials and a liquid may be formed into a paste and used to coat the walls of the chamber.

Articles of the type disclosed herein may be used or may be modified for use as drug delivery articles, for delivery of volatile pharmacologically or physiologically active materials such as ephedrine, metaproterenol, terbutaline or the like.

In most embodiments of the invention, the fuel/aerosol generating means combination will be attached to a mouthend piece, such as a foil lined paper tube, although a mouthend piece may be provided separately, e.g., in the form of a cigarette holder. This element of the article provides the enclosure which channels the vaporized aerosol forming substance into the mouth of the user. Due to its length, preferably about 50 to 60 mm or more, it also keeps the hot fire cone away from the mouth and fingers of the user.

Suitable mouthend pieces should be inert with respect to the aerosol forming substances, should have a water or liquid proof inner layer, should offer minimum aerosol loss by condensation or filtration, and should be capable of withstanding the temperature at the interface with the other elements of the article. Preferred mouthend pieces include the foil lined paper tube of FIGS. 1 and 2, the cellulose acetate tube employed in the embodiment of FIG. 3, and a closed cellular formed tube. Other suitable mouthend pieces will be apparent to those of ordinary skill in the art.

The mouthend pieces of the invention may include an optional "filter" tip, which is used to give the article the appearance of the conventional filtered cigarette. Such filters include low density cellulose acetate filters and hollow or baffled plastic filters, such as those made of polypropylene. In addition, the entire length of article or any portion thereof may be overwrapped with cigarette paper. Preferred papers, especially used when an insulating member is employed, should not openly flame during buring of the fuel element, should produce a grey, cigarette-like ash, and should have sufficient porosity to provide peripheral air flow through the preferred insulating fibers to support combustion of the fuel element during smolder. One such paper is EUCSTA 01788, produced by Ecusta Inc., of Pisgah Forest, N.C.

The insulating means which may be used in practicing this invention may be selected from any materials which act primarily as insulators. Preferably, these materials do not burn during use, but they may include slow burning carbons and like materials, as well as materials which fuse during use, such as low temperature grades of glass fibers. Such materials generally include inorganic fibers such as those made out of glass, alumina, silica, vitreous materials, carbons, silicons, boron, and the like, including mixtures of such materials. Such materials have a thermal conductivity in g-cal/(sec)(cm$^2$)(°C./cm) of less than about 0.05, preferably less than about 0.02, most preferably less than about 0.005. See, *Hackh's Chemical Dictionary,* 34 (4th ed, 1969) and Lange's *Handbook of Chemistry,* 10, 272–74 (11th ed., 1973).

Several commercially available insulating fibers are prepared with a binder e.g., PVA, which acts to maintain structural integrity during handling. These binders should be removed, e.g., by heating in air at about 650° C. for up to about 15 min. before use herein.

The currently preferred insulating fibers are ceramic fibers, such as glass fibers. Two especially preferred glass fibers are available from the Manning Paper Company of Troy, N.Y., under the designations, Manniglas 1000 and Manniglas 1200. Generally the insulating fiber e.g., Manniglass 1200 is wrapped over at least a portion of the fuel element and any other desired portion of the article, preferably with an overwrapped layer of Manniglas 1000, to a final diameter of from about 7 to 8 mm. Thus, the preferred thickness of the insulating layer is from about 0.5 mm to 2.5 mm, preferably, from about 1 mm to 2 mm. When possible, glass fiber materials having a low softening point, e.g., below about 650° are preferred.

The heat conducting member preferably employed in practicing this invention is typically a metallic foil, such as an aluminum foil, varying in thickness from less than about 0.01 mm to about 0.1 mm, or more. The foil preferably used in this invention is typically an aluminum foil of 0.35 to 4 mils (0.0089 to 0.1 mm) in thickness, but the thickness and/or the type of metal employed may be varied to achieve any desired degree of heat transfer. Other types of heat conducting members such as Grafoil, available from Union Carbide, also may be employed.

The aerosol produced by the preferred articles of the present invention is chemically simple, consisting essentially of air, oxides of carbon, the aerosol which carries any desired flavors, water and trace amounts of other materials. The wet total particulate matter (WTPM) produced by the preferred articles of this invention has no mutagenic activity as measured by the Ames Test, i.e., there is no significant dose response relationship between the WTPM of the present invention and the number of revertants occurring in standard test microorganisms exposed to such products. According to the proponents of the Ames Test, a significant dose dependent response indicates the presence of mutagenic materials in the products tested. See Ames et al., *Mut. Res.,* 31:347–364 (1975); Nagad et al., *Mut. Res.,* 42:335 (1977).

A further benefit from the preferred embodiments of the present invention is the relative lack of ash produced during use in comparison to ash from a conventional cigarette. As the preferred carbon fuel source is burned, it is essentially converted to oxides of carbon, with relatively little ash generation, and thus there is no need to dispose of ashes while using the article.

The smoking article of the present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius and are uncorrected. In all instances, the articles have a diameter of about 7 to 8 mm, the diameter of a conventional cigarette.

EXAMPLE 1

A smoking article having the fuel element and aerosol generating means configuration of FIG. 1 was made using a 15 mm long annular pressed carbon fuel element with an inner diameter of about 4 mm and an outer diameter of about 8 mm. The fuel was made from 90% PCB-G activated carbon and 10% SCMC. The substrate was a 10 mm long piece formed of Union Carbide PC-25 carbon with an external diameter of about 4 mm. The substrate, loaded with 55 mg of a 1:1 glycerin/propylene glycol mixture, was inserted within the end of the fuel closer to the mouthend of the article. This fuel/substrate combination was inserted 7 mm into a 70 mm foil lined tube which had a short cellulose acetate filter at the mouth end. The length of the article was about 77 mm.

The article delivered substantial amounts of aerosol on the first three puffs, as well as over the useful life of the fuel element.

EXAMPLE 2

A smoking article having the fuel element and aerosol generating means similar to configuration of FIG. 1 was made using a 10 mm long pressed carbon fuel element made from 90% PCB-G activated carbon and 10% SCMC. The fuel element had an outer diameter of about 8 mm and was formed with a central passageway of about 1 mm diameter.

A 4 mm diameter cavity was drilled to a depth of about 4 mm on the mouthend of the fuel. The substrate, inserted into the 4 mm cavity of the fuel source, was formed from Union Carbide PC-25 carbon. It was saturated with about 25 mg of a 1:1 mixture of glycerin and propylene glycol. The fuel source/substrate assembly was inserted into the end of a foil-lined tube to a depth of about 3 mm. The article had a final length of 77 mm. In smoking the article, aerosol delivery was very high even on the initial puffs.

EXAMPLE 3

A carbon fuel source was formed with an outer diameter of 8 mm; an inner diameter of about 4 mm; and a length of 10 mm. A foil tube was formed from aluminum to a diameter that would fit snugly inside the cavity in the fuel source. The length of the aluminum tube was about 20 mm. A cylindrical substrate was formed from Union Carbide PC-25 carbon and cut to a length of 10 mm. The substrate, saturated with a 1:1 mixture of glycerin and propylene glycol, was inserted into the aluminum tube such that it was contained in the mouthend half of the tube. The fuel source/substrate assembly was inserted into the end of a foil-lined tube such that about 7 mm of the fuel source was left exposed. Upon smoking, the article performed well; i.e., aerosol delivery was visible on the first two puffs, and increased significantly thereafter.

What is claimed is:

1. A smoking article comprising:

(a) a carbonaceous fuel element having a cavity therein; and (b) a physically separate aerosol generating means including an aerosol forming material, the aerosol generating means being at least partially embedded within the cavity in said fuel element.

2. The article of claim 1, wherein the fuel element is less than 30 mm in length.

3. A smoking article comprising:

(a) a carbonaceous fuel element substantially free of volatile material having a cavity therein;

(b) a physically separate aerosol generating means including an aerosol forming material, the aerosol generating means being at least partially embedded within the cavity in said fuel element; and (c) means for delivering the aerosol produced by the aerosol generating means to the user.

4. The article of claim 3, wherein the fuel element is less than 30 mm in length.

5. A smoking article comprising:

(a) a combustible fuel element less than about 30 mm in length having a cavity therein; and (b) a physically separate aerosol generating means including an aerosol forming material, the aerosol generating means being at least partially embedded within the cavity in said fuel element.

6. The article of claim 1, 3, or 5 wherein the fuel element is less than about 15 mm in length.

7. The article of claim 1, 2, 3, 4, or 5 further comprising an insulating member surrounding at least a portion of the fuel element.

8. The article of claim 8, wherein the insulating member is at least 0.5 mm thick.

9. The article of claim 8, wherein the insulating member comprises a resilient jacket of fibers.

10. The article of claim 1, 2, 3, 4, or 5 further comprising a heat conducting member which contacts both the fuel element and the aerosol generating means.

11. The article of claim 10, wherein the heat conducting member is metallic.

12. The article of claim 10, further comprising an insulating member surrounding at least a portion of the periphery of the fuel element.

13. The article of claim 1, 3 or 5, wherein the aerosol generating means comprises a thermally stable material.

14. The article of claim 13, wherein the thermally stable material comprises a nonparticulate porous carbon.

15. The article of claim 1, 3, or 5, further comprising a mouthend piece.

16. The article of claim 1, 3, or 5, further comprising a charge of tobacco located between the fuel element and the mouth end of the article.

17. The article of claim 1, 3, or 5, wherein the aerosol generating means is less than about 30 mm in length.

18. The article of claim 1, 3, or 5, where the areosol generating means is less than about 15 mm in length.

19. The article of claim 1, 3, or 5, wherein the aerosol generating means comprises a barrier between at least a portion of the fuel element and the aerosol forming material, said barrier limiting the introduction of fuel element combustion products into the aerosol stream.

20. The article of claim 1, 3, or 5, wherein the fuel element and the aerosol generating means are arranged such that the aerosol generating means receives conductive heat transfer substantially throughout the burning of the fuel element, and convective heat transfer during the period when an aerosol is being drawn by the user.

21. The article of claim 1, 2, 3, 4, or 5, wherein the article delivers at least about 0.6 mg of wet total particulate matter in the first three puffs under smoking conditions of 35 ml puffs, of two seconds duration, separated by 58 seconds of smolder.

22. The smoking article of claim 1, 2, 3, 4 or 5, wherein the fuel element is at least about 80% carbon by weight.

23. The smoking article of claim 6, wherein the fuel element is at least about 80% carbon by weight.

24. The smoking article of claim 2, 4 or 5, wherein the smoking article has the shape and size of a cigarette.

25. The smoking article of claim 24, wherein the article delivers at least about 1.5 mg of wet total particulate matter in the first three puffs under smoking conditions of 35 ml puffs, of two seconds duration, separated by 58 seconds of smolder.

26. The smoking article of claim 1, 2, 3, 4, or 5, wherein the article delivers an average of at least about 0.8 mg of wet total particulate matter per puff under smoking conditions of 35 ml puffs, of two seconds duration, separated by 58 seconds of smolder.

27. The smoking article of claim 7, wherein the article delivers an average of at least about 0.8 mg of wet total particulate matter per puff under smoking conditions of 35 ml puffs, of two seconds duration, separated by 58 seconds of smolder.

28. The smoking article of claim 1, 3, or 5, wherein the aerosol produced by the smoking device contains no significant mutagenic activity, as measured by the Ames Test.

* * * * *

UNITED STATES PATENT AND TRADEMARK OFFICE

CERTIFICATE OF CORRECTION

PATENT NO. : 4,928,714

DATED : May 29, 1990

INVENTOR(S) : Michael D. Shannon

It is certified that error appears in the above—identified patent and that said Letters Patent is hereby corrected as shown below:

On the title page:
Under [56] Foreign Patent Documents, add 1185887 6/1967 United Kingdom Column 8, line 49, "mas" should be --mass--.

Column 12, line 65, "buring" should be --burning--.

Column 13, line 64, "Nagad" should be --Nagao--.

In the claims

Claim 1, column 15, line 8, delete "including", insert --consisting essentially of a thermally stable substrate bearing--.

Claim 2, column 15, cancel lines 11 and 12, insert --2. A smoking article comprising: (a) a carbonaceous fuel element less than 30 mm in length prior to smoking, and having a cavity therein; and (b) a physically separate aerosol generating means consisting essentially of a thermally stable substrate bearing an aerosol forming material, the aerosol generating means being at least partially embedded within the cavity in said fuel element.--

UNITED STATES PATENT AND TRADEMARK OFFICE

CERTIFICATE OF CORRECTION

PATENT NO. : 4,928,714

DATED : May 29, 1990

INVENTOR(S) : Michael D. Shannon

It is certified that error appears in the above-identified patent and that said Letters Patent is hereby corrected as shown below:

Column 16, after line 51, insert the following claims:

29. The smoking article of claim 1, 2 or 3, wherein the substrate is within a container.

30. The smoking article of claim 1, wherein the fuel element is less than 30 mm in length prior to smoking.

Signed and Sealed this

Fifth Day of May, 1992

*Attest:*

*Attesting Officer*

DOUGLAS B. COMER

*Acting Commissioner of Patents and Trademarks*